United States Patent [19]

Lamb

[11] 4,439,985

[45] Apr. 3, 1984

[54] POWER TRANSMISSION FOR A STIRLING HOT GAS ENGINE

[76] Inventor: Gerald P. Lamb, 2648 Hartford St., San Diego, Calif. 92110

[21] Appl. No.: 421,902

[22] Filed: Sep. 23, 1982

[51] Int. Cl.[3] ..... F02G 1/04

[52] U.S. Cl. ..... 60/518; 60/525

[58] Field of Search ..... 60/517, 518, 525

[56] References Cited

U.S. PATENT DOCUMENTS

| | | | |
|---|---|---|---|
| 2,508,315 | 5/1950 | Van Weenan et al. | 60/518 |
| 3,183,662 | 5/1965 | Korsgren | 60/518 |
| 3,315,465 | 4/1967 | Wallis | 60/518 |

*Primary Examiner*—Allen M. Ostrager
*Attorney, Agent, or Firm*—Frank D. Gilliam

[57] ABSTRACT

An improved transmission from linear power to rotary power in a Stirling heat engine having at least one cylinder with power and displacement pistons linearly operable therein. The power and displacement piston shafts are each interconnected to a common drive shaft through an actuating arm. The power and displacement shaft connections to the actuating arms are through universal joints and their drive shaft connections are rotary connections. The rotary connections of the actuating arms to the drive shaft are eccentrics or cams angularly displaced from the longitudinal center line of the drive shaft and rotatably positioned relative to each other so as to provide the proper operational phase angle of the pistons. A timing shaft running through at least a portion of the drive shaft is translatable a discrete distance to change the relative rotational positions of the eccentrics or cams through 180° of rotation displacement piston eccentric rotates 90° while the power piston eccentric rotates 90° in the opposite direction. Translation of the timing shaft can be accomplished while the engine is in operation to provide engine power and rotational directional control.

12 Claims, 4 Drawing Figures

POWER TRANSMISSION FOR A STIRLING HOT GAS ENGINE

BACKGROUND OF THE INVENTION

In fixed phase angle Stirling cycle engines, which is a typical form of hot gas energy transforming device, there is generally provided a power piston and a displacer piston powered by the power piston. The engine is usually constructed using a predetermined and fixed phase angle between the power piston and the displacer piston so that maximum engine power is obtained. This predetermined phase angle may be 90°. For better understanding, phase angle is described as the distance the displacer piston leads the power piston in the direction of rotation. For example: if displacer piston leads power piston in clockwise rotation, the engine will then run clockwise. Thus, by modifying or changing the piston phase relation, it is possible to control the engine's power output from zero power to maximum power output in either rotational direction.

Typically, power transmission from the power piston to the displacement piston and drive shaft or power take off are accomplished through gears and levers as taught by U.S. Pat. Nos. 2,508,315; 2,885,855; 3,077,732; 3,416,307; 3,416,308; and 3,482,457.

As taught by the referenced patents, the mechanism is excessively complex, requires numerous operable components, has considerable power loss due to friction and because of the number of components required there is considerable economic expense for their production.

There has not been an entirely satisfactory means for transmitting the power from the power piston to the displacement piston and output power drive shaft until the emergence of the present invention.

SUMMARY OF THE INVENTION

This invention provides a means for transferring the linear motion from one or more power pistons of Stirling, hot gas engines to their accompanying displacement pistons and for changing the linear motion from the power pistons to a common rotary output power drive shaft. The invention is adaptable equally as well to single or multi-cylinder Stirling type engines. The requirement of stopping the operation of the engine and making complex mechanical changes to the engine in order to change the direction of drive shaft rotation has been overcome. In addition, the phase angle between the power and displacement pistons can be varied while the engine is operating to vary the engine output power.

According to the present invention the Stirling type hot gas engine includes a pair of power piston actuated arms. One actuating arm is connected between the displacement piston shaft and the common drive shaft and the other actuating arm is connected between the power piston shaft and the common drive shaft. The piston rod connections to the actuating arms is in the form of a conventional universal joint. The actuating arm to the drive shaft connection is rotatable about an eccentric attached to the drive shaft and displaced at a preselected angle from the longitudinal center line of the drive shaft.

The eccentrics can be fixed in place relative to the drive shaft or rotationally positioned relative thereto for changing the power and displacement piston phase angle in order to change the engine output power or operational direction of the drive shaft. When a single cylinder engine uses a counter balance it is installed at the drive shaft end of the actuator arm in tests, it has been found that counter balancing small engines is not necessary for smooth running.

The invention can be used in multi-cylinder engines. For multi-cylinder engine use, diametrically opposed pairs of cylinders are positioned on opposite sides of the common drive shaft and are interconnected to that common drive shaft by actuating arms that extend from the common drive shaft in both directions for interconnecting pairs of opposed displacement and power piston rods. Phase angle changes between associated displacement and power pistons are accomplished in the same manner as in the single cylinder engines. Counter weights are not required in multi cylinder engine embodiments as substantially a perfect balance is inherent in this configuration.

An object of this invention is to provide an efficient linear to rotational power conversion for a Stirling hot gas engine.

Another object of this invention is to provide an improved means for varying the power output of a Stirling hot gas engine.

Still another object of this invention is to provide an improved means for reversing the operation of a Stirling hot gas engine.

Still a further object of this invention is to provide means for a combined varying of the output power and operational direction of a Stirling hot gas engine without mechanical changes to the engine and while the engine is operating.

These and other objects of the invention will be more apparent from the following description and drawings in which:

DETAILED DESCRIPTION OF THE DRAWINGS

Throughout the various drawing Figures and specification the same numerals are used to depict the same or identical component or part.

Figure 1:
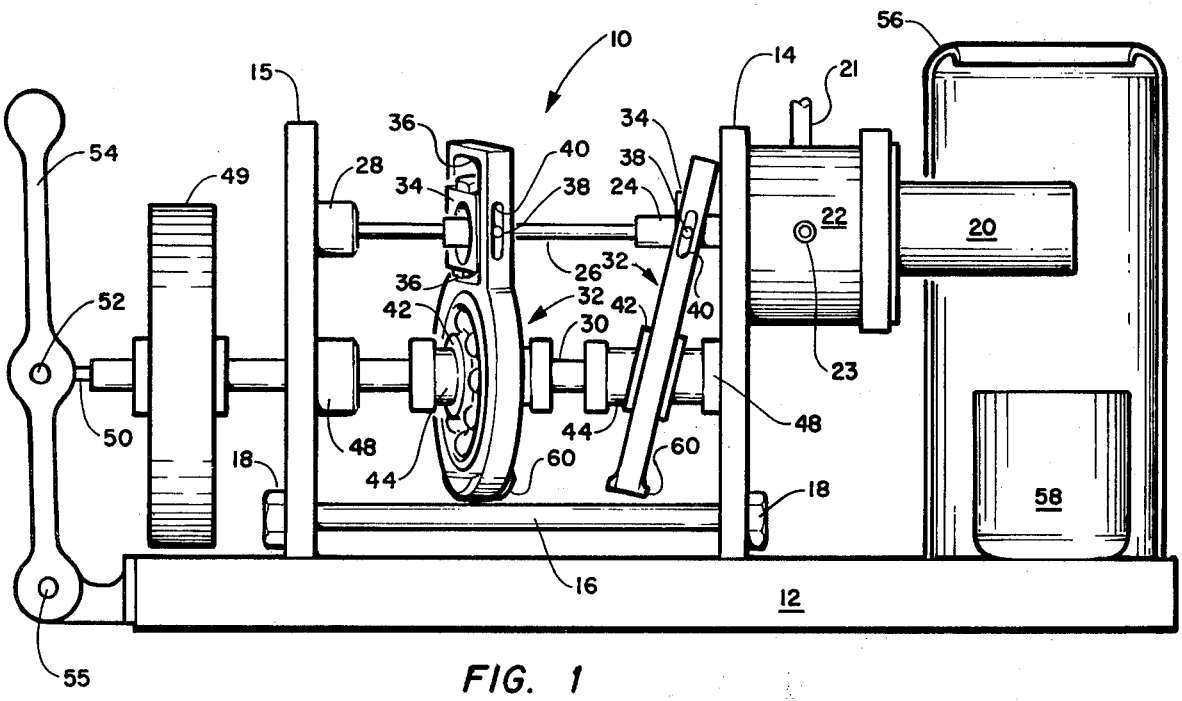
FIG. 1 is a side view of a single cylinder Stirling hot gas engine employing the invention.

Referring now to the drawing Figures and more specifically to FIG. 1, a Stirling type hot gas engine 10 is shown. A base member 12 provides a rigid support for the components comprising the engine assembly. Positioned on the base member 12 are a pair of spaced apart housing uprights 14 and 15. The housing uprights are fixedly secured to the base member by means of welding or the like or by use of fastening means, such as screws or the like passing partially through the base and threadedly engaging the housing uprights. The housing uprights 14 and 15 are held in a spaced apart position shown by means of spacers 16, one shown. The spacers are secured to the housing uprights by a fastener such as a rod or the like (not shown) passing through the spacer. The ends of the rod are threaded to accept nuts 18 thereon, likewise, the spacer may be welded or the like to the housing uprights, or the entire housing assembly can be cast as one unit.

On the upper end of the housing upright 4 is a cylinder 20 which contains a conventional translatable displacement and power piston therein. The pistons will be described hereinafter in more detail. Surrounding the cylinder 20 is a cooling sink or radiator 22. The cooling sink or radiator surrounds the cylinder 20 adjacent its housing upright connected end. The cooling sink or radiator is utilized to cool its adjacent end of the cylinder. The sink or radiator 22 may provide cooling by simple radiation or may include an inner chamber for receiving a cooling fluid through conduits 21 and 23.

Extending from the cylinder 20 through the housing upright 14 is a pair of linear translatable shafts 24 and 26. Shaft 24 is connected to the power piston and shaft 26 is connected to the displacement piston. Shaft 26 freely translates within the shaft 24. The distal end of the displacement shaft 26 is guided by a linear bushing 28 secured in an aperture in housing upright 15.

The power piston shaft 24 is connected to a common drive shaft 30 by an actuating arm 32. The actuating shaft 26 is likewise connected to the common drive shaft 30 by an actuating arm 32. Both of the shaft connections are by conventional universal joint means 34. The upper and lower universal joint pivot pins 36 are fixed in position and the side pins 38 translate along slot 40. The universal joint acts in a conventional manner allowing angular and vertical movement of the actuating arms relative to the linear actuating shafts. The actuating arm connection to the common drive shaft 30 is through an eccentric 42 offset and angled from the center line of the drive shaft and is attached through a support member 44 connected to the drive shaft 30. The support members 44 are either fixedly connected to the drive shaft or rotatable relative thereto, as hereinafter discussed in more detail, by a radial thrust bearing 46.

Figure 4:
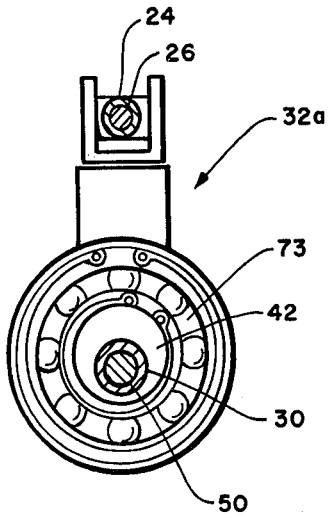
FIG. 4 is an end view of FIG. 3.

The drive shaft is held in position by end bearings 48 secured to the housing uprights. The drive shaft 30 extends through housing upright 15 and has a power take off fly wheel 49 attached thereto. A timing shaft 50 extends through the longitudinal center of the drive shaft either partially or substantially its entire length. The timing shaft is translatable to change the normally 90° displaced eccentrics 42 of the power and displacement pistons to change the output power or rotational direction of the drive shaft 30. A detailed discussion of the operation of the timing shaft will be hereinafter explained in greater detail. The end of the timing shaft is pivotly attached at 52 to timing shaft translating arm 54. The timing shaft translating arm 54 is pivotly attached at 55 to the base member 12. It should be understood that the timing shaft may be translated by any means including a power actuated screw of the like as shown in FIG. 4.

Surrounding the distal end of the cylinder is a heat insulating shield 56. A source of heat 58 is positioned below the distal end of the cylinder for operating the engine.

A counter weight or balance 60 is added to the common drive shaft connected end of the actuating arms to dynamically balance the engine.

Figure 2:
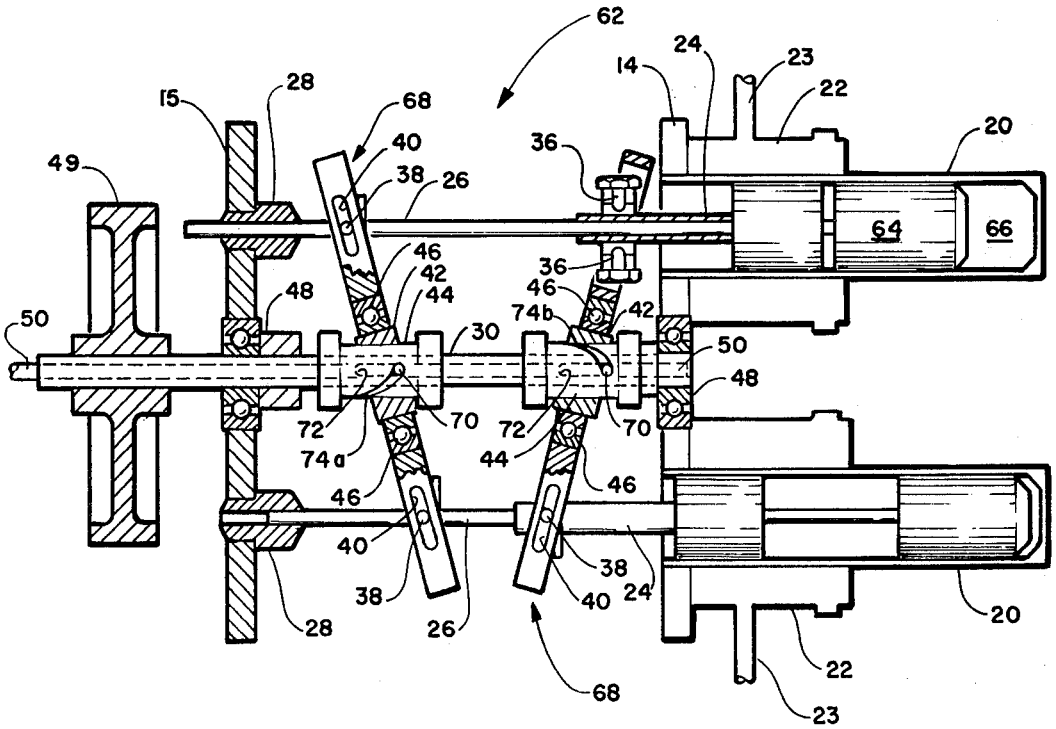
FIG. 2 is a cut-a-way plan view of a twin cylinder Stirling hot gas engine employing the invention.

Referring now to FIG. 2, there is shown a cut-a-way plan view of a two cylinder engine 62 employing the invention. The engine 62 operates substantially in the same manner as engine 10. The engine 62 includes a pair of cylinders 20 each having power and displacement pistons 64, 66 respectively. The power and displacement pistons of both cylinders are respectively connected at each end of a common actuating arm 68 by universal means as hereinbefore discussed. The center of each actuating arm 68 is also connected to the common drive shaft in the same manner as hereinbefore discussed as well as is the piston shafts connection. Counter weights or balances 60 are not required in this embodiment because the mechanism provides its own inherent balance. The drive shaft end bearing 48 is shown as a ball bearing type. Any suitable type bearing may be used.

Figure 3:
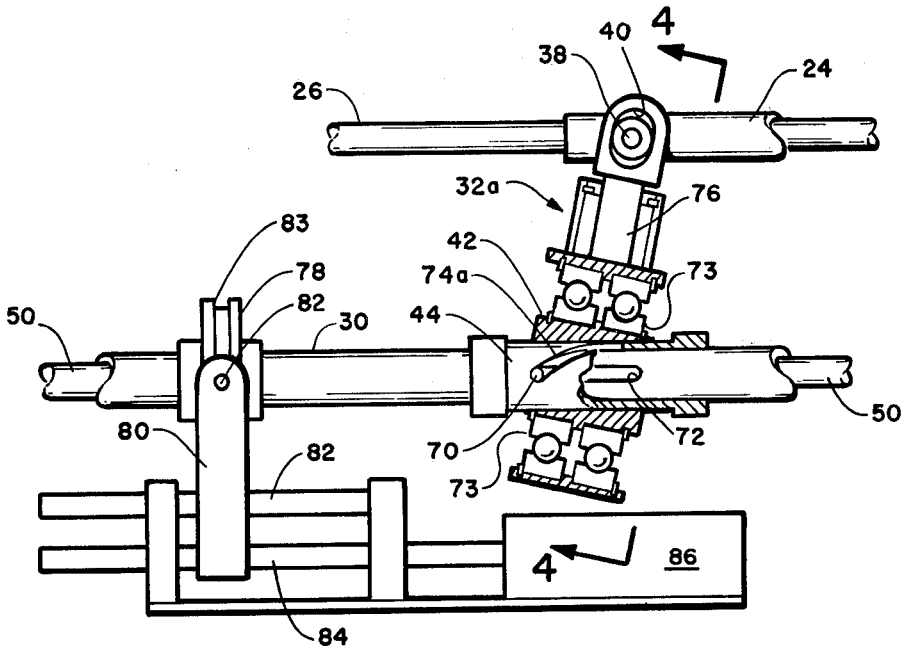
FIG. 3 is a partial cut-a-way side view of the embodiment of FIG. 1 showing the phase angle and engine directional changing mechanism.

The cut-a-way showing of the drive shaft and actuating arms exposing the means for providing relative rotation displacement of the actuating arms 32 with respect to the drive shaft. The timing shaft 50 is shown within the drive shaft 30. Pins 70, located in two places on the timing shaft passes through slots 72 in the drive shaft and a slots **74*a* and 74*b* in the eccentric support 44. The slot 72 is longitudinal with the center line of the drive shaft and the slots 74*a* and 74*b* are curvilinear relative to the longitudinal center line so as to allow each eccentric support 44 to rotate substantially 90° relative to the drive shaft thus providing a total relative rotation therebetween of 180°. As shown, the slots 74*a* and 74*b* causes one eccentric support to rotate in one direction and the other eccentric support to rotate in the opposite direction, thus each eccentric rotate substantially 90° in opposite directions. It is possible to provide only one eccentric with rotation while the other remains fixed. As shown in FIG. 3, one slot 74** is provided that may be sufficiently long to allow one eccentric to rotate 180° about the drive shaft while the other eccentric is fixed in position relative thereto.

Referring now specifically to FIGS. 3 and 4, FIG. 3 is a partial cut-a-way showing of a second embodiment of the actuating arm and shows the engine timing system in more detail. FIG. 4 is an end view taken along line 4—4 of FIG. 3. The actuating arm assembly **32*a* includes a universal joint connection to the piston shafts. This universal joint includes a connector 76 that is rotatably and translatably connected to a piston shaft and is rotatable relative to the lower portion of the actuating arm. The actuating arm assembly 32*a* is connected to the common drive shaft 30 through an eccentric 42 overlaying the timing shaft 50 and drive shaft 30 and connected thereto through a pin and slot combination hereinbefore discussed. A pair of back to back ball bearings bushings 73 provide a low friction rotatable connection between the lower end of the actuating arm assembly 32*a*** and the eccentric.

As can be seen in FIG. 3, the translation of timing shaft 50 causes the pin 70 to translate relative to the drive shaft along slot 72 causing the eccentric 42 arm assembly to rotate along its slot 74.

The timing shaft 50 is connected to a cylindrical yoke 78 by a pin not shown which causes the yoke to rotate with the drive shaft and timing shaft. A pair of arms 80, one shown, each have a pin 82 which engages the groove 83 in yoke 78 while allowing the yoke to rotate. The low end of arm 80 is guided by guide rod 82 and is attached to a translating shaft 84. The shaft 84 is translated by power means 86. Any type of suitable linear power source can be utilized for translation of shaft 84. It should be obvious that the translation of shaft 84 causes guide rod 82 to translate timing shaft 50 causing the eccentric to rotate relative to the drive shaft.

It should be understood that the pins used to connect the eccentric to the drive shaft via the longitudinal slot must be sufficiently strong to withstand the driving power of the engine.

Throughout the various drawings the eccentric 42 are shown as being angled from the longitudinal center line of the drive shaft 30. The degree of inclination of the eccentric 42 is determined from the physical dimension of the engine and the stroke of the pistons. To establish this angle of inclination for a given engine a perpendicular line is established between the center of the piston's stroke and the drive shaft. From the point of contact of the perpendicular line on the drive shaft the longitudinal center of the eccentric is established. The piston is then displaced from the center of its stroke to one extreme end of its stroke. A second line is then established between the now translated point on the piston shaft and the established longitudinal center of the eccentric. The angle of inclination of the eccentric centered on the drive shaft follows the angle of inclination of this second line.

The operation of a Stirling hot gas engine will not be explained as it is conventional and well known in the art.

Conventionally, the displacement piston leads the power piston and it has been established that in the most efficient operation of the engine displacement piston will lead the power piston by approximately 60° to 90° depending on the output power requirement. During normal operation of the engine (maximum power) the timing shaft will be translated to one extreme position, i.e., all the way in or all the way out. This will cause the engine to operate normally at full power resulting in either clockwise or counter clockwise rotation of the drive shaft 30. It should be understood that as the timing shaft is translated from a maximum translated position the relative phase angle between the power and displacement pistons will decrease from 90° either plus or minus toward 0°. At one half way through its translation 0° relative rotational displacement will be achieved, stopping the operation of the engine. As the timing shaft is translated past 0° toward the opposite maximum translated position, the engine again operates with increasing power in an opposite rotational direction as the engine approaches 90° phase angle in the opposite direction. Obviously a desired power output level or rotational direction can be selected at any time while the engine is in operation. It should be understood that engine output power can be varied by varying the intensity of the heat source or by a combination of heat and phase angle changes.

The various constituent components of the engine and improved power transmission may be constructed of any suitable material or materials that are best suited for the purpose intended.

The above-described embodiments of the invention are illustrative of the invention which may be modified within the scope of the appended claims.

What is claimed is:

1. Improved linear to rotary power transmission for a Stirling type heat engine having at least one common cylinder with a power piston and displacement piston operating therein, said power piston connected to a power piston shaft and said displacement piston connected to a displacement piston shaft, said displacement piston shaft linearly translatable within said power piston shaft with its distal end extending beyond the distal end of said power piston shaft and a common rotary drive shaft with a flywheel connected to one end thereof comprising:

a pair of connecting arms, one connected between said displacement piston shaft and said common drive shaft and the other connected between said power piston shaft and said common drive shaft, said connections to said piston shafts comprise universal joint means and said connections to said common drive shaft comprises a rotatable connection through axial eccentrics fixed in position on said common drive shaft, said axial eccentrics having a selected angular displacement from the longitudinal center line of said common drive shaft whereby said pistons operably translate within said cylinder while maintaining a preselected relative displacement between said pistons.

2. The invention as defined in claim 1 wherein the common drive shaft end surface of said actuating arms are counter balanced.

3. The invention as defined in claim 1 wherein a pair of said cylinders are employed and said actuating arms extend from the common drive shaft in both directions to accommodate respective displacement and power shafts from pistons in both cylinders.

4. The invention as defined in claims 1 or 2 wherein radial thrust bearings are positioned between the eccentric and the actuating arm connections.

5. The invention as defined in claims 1 or 2 wherein there is additional provided means for reselecting the relative rotational displacement between said axials eccentrics, whereby the rotational speed of the common drive shaft can be changed and its direction of rotation can be reversed while said engine is operating.

6. The invention as defined in claims 1 or 2 wherein said means for reselecting the relative rotational displacement between said axial eccentrics comprises a timing shaft extending longitudinally through at least a portion of said common drive shaft, at least one pin fixedly attached to said timing shaft, at last one longitudinal slot in said common drive shaft substantially the width of said at least one pin, whereby said at least one pin passes through said at least one longitudinal slot in said common drive shaft allowing said timing shaft to translate relative to said common drive shaft the length of said at least one longitudinal slot, at least one sleeve having a curvilinear slot along at least the inner surface thereof for engaging said pin, whereby when said timing shaft is translated along said longitudinal slots at least one eccentric rotates relative to the other eccentric changing their relative rotational displacement.

7. The invention as defined in claim 6 wherein the change in said relative rotational displacement of said eccentrics can be selected through a range of positions from +90° to −90° of rotation.

8. The invention as defined in claim 6 wherein the change of said relative rotational displacement of said eccentrics is 180° of rotation.

9. The invention as defined in claim 1 or 2 wherein said means for reselecting the relative rotational displacement between said axial eccentrics comprises a timing shaft extending longitudinally through at least a portion of said common drive shaft, a pair of pins fixedly attached to said timing shaft, a pair of longitudinal slots in said common drive shaft substantially the width of said pins, whereby each pin pass through one of said longitudinal slots in said common drive shaft allowing said timing shaft to translate relative to said common drive shaft the length of said longitudinal slots, a pair of sleeves having a oppositely directed curvilinear slots along at least the inner surface each engaging one of said pins, one of said axials eccentrics being fixedly attached to each of said sleeves, whereby when said timing shaft is translated along said longitudinal said eccentrics are caused to rotate relative to one another in opposite rotational directions changing their relative rotational displacements.

10. The invention as defined in claim 9 wherein each of said axial eccentrics can be rotatably displaced from 0° to 90°.

11. The invention as defined in claim 9 wherein the relative positioned rotation between said axials eccentrics can be changed substantially 180°.

12. The invention as defined in claim 1 wherein said angular displacement of said axial eccentrics is determined by the length of stoke of said pistons within said cylinder as calculated from a perpendicular line from the center of said stroke to said common drive shaft at which location said connecting arms are attached.

* * * * *